US009795223B1

(12) United States Patent
Shih

(10) Patent No.: US 9,795,223 B1
(45) Date of Patent: Oct. 24, 2017

(54) REAR FRAME OF ELECTRIC BED

(71) Applicant: Chuan-Hang Shih, Changhua County (TW)

(72) Inventor: Chuan-Hang Shih, Changhua County (TW)

( * ) Notice: Subject to any disclaimer, the term of this patent is extended or adjusted under 35 U.S.C. 154(b) by 0 days.

(21) Appl. No.: 15/630,265

(22) Filed: Jun. 22, 2017

(51) Int. Cl.

| | |
|---|---|
| ***A61G 7/018*** | (2006.01) |
| ***A47C 19/02*** | (2006.01) |
| ***A61G 7/002*** | (2006.01) |
| *A61G 7/00* | (2006.01) |
| *A47C 19/00* | (2006.01) |

(52) U.S. Cl.
CPC ..... *A47C 19/021* (2013.01); *A61G 7/002* (2013.01); *A61G 7/018* (2013.01); *A47C 19/00* (2013.01); *A61G 7/00* (2013.01); *A61G 2203/70* (2013.01)

(58) Field of Classification Search
CPC ..... A47G 7/018
USPC ..... 5/600, 610, 613–618
See application file for complete search history.

(56) References Cited

U.S. PATENT DOCUMENTS

| | | | | |
|---|---|---|---|---|
| 3,317,931 A * | 5/1967 | Benoit | ..... | A61G 7/015 5/616 |
| 9,125,776 B1 | 9/2015 | Shih | | |
| 2011/0094032 A1 * | 4/2011 | Shih | ..... | A47C 20/041 5/614 |

* cited by examiner

*Primary Examiner* — Frederick Conley
(74) *Attorney, Agent, or Firm* — Muncy, Geissler, Olds & Lowe, P.C.

(57) ABSTRACT

A rear frame adapted to form an electric bed with a front frame includes a fixation rack, a thigh supporting rack pivotally connected with the fixation rack, a lower leg supporting rack pivotally connected with the thigh supporting rack, a support rack located under the lower leg supporting rack and pivotally connected with fixation rack, a front extension rack, a rear extension rack, a link, and an actuator. The front extension rack is disposed to a bottom side of the thigh supporting rack, the rear extension rack is disposed to a bottom side of the support rack, the link is pivotally connected between the front and rear extension racks, and the actuator is pivotally connected between the fixation rack and the rear extension rack in a way that the lower leg supporting rack is swingable downwardly.

10 Claims, 11 Drawing Sheets

REAR FRAME OF ELECTRIC BED

BACKGROUND OF THE INVENTION

1. Field of the Invention

The present invention relates generally to a bed frame and more particularly, to a rear frame of an electric bed.

2. Description of the Related Art

Conventional electric beds are known having a large size and therefore difficult to be transported. U.S. Pat. No. 9,125,776 discloses an electric bed having a lower leg support capable of being lifted up and lowered down. For such a bulky electric bed, a user may encounter a problem of storage when the user is temporarily not to use the electric bed. Further, even if the user wants to dismantle the electric bed into parts, for example dismantle the electric bed into front part and rear part, the user will have a difficulty in doing so because some of the components that lift and lower the rear part of the electric bed are mounted to the front part of the electric bed, resulting in that the use cannot easily depart the electric bed into the front and rear parts, but into pieces. As such, how to make an electric bed having the advantages of convenient storage and transport with an inclinable lower leg support is an issue needed to be considered and resolved by manufacturers.

SUMMARY OF THE INVENTION

The present disclosure has been accomplished in view of the above-noted circumstances. It is an objective of the present disclosure to provide a rear frame of an electric bed, which is adapted to be cooperated with a front frame to form an electric bed. The rear frame and the front frame can be easily assembled with and dismantled from each other for convenient storage and transport. Further, the rear frame comprises a lower leg supporting rack swingable downwardly.

To attain the above objective, the present disclosure provides a rear frame of an electric bed, which comprises a fixation rack, a thigh supporting rack, a lower supporting rack, a support rack, a front extension rack, a rear extension rack, a link, and an extendible and retractable actuator. The fixation rack has a front end portion and a rear end portion. The thigh supporting rack has a front end portion pivotally connected with the front end portion of the fixation rack, and a rear end portion disposed on the rear end portion of the fixation rack. The lower leg supporting rack has a front end portion pivotally connected with the rear end portion of the thigh supporting rack, and a rear end portion. The support rack is located under the lower leg supporting rack and provided with a front end portion pivotally connected with the rear end portion of the fixation rack, and a rear end portion on which the rear end portion of the lower leg supporting rack is disposed. The front extension rack is disposed to a bottom side of the thigh supporting rack and provided with an elongated groove extending in a back-and-forth direction of the rear frame. The rear extension rack is disposed to a bottom side of the support rack. The link has a front end portion pivotally connected with the front extension rack and reciprocally moveable along the elongated groove, and a rear end portion pivotally connected with the rear extension rack. The actuator has a front end portion pivotally connected with the front end portion of the fixation rack, and a rear end portion pivotally connected with the rear extension rack. The actuator is extendible and retractable to change its length. When the actuator stays in an initial status, a top side of the thigh supporting rack is flush with a top side of the lower leg supporting rack. When the actuator retracts from the initial status, the actuator pulls the rear extension rack to force the support rack to swing downwardly, such that the lower leg supporting rack swings downwardly along with the support rack, the front end portion of the link moves forwards along the elongated groove, and the thigh supporting rack stays stationary. When the actuator extends from the initial status, the actuator pushes the rear extension rack to force the support rack to swing upwardly, such that the rear end portion of the lower leg supporting rack is lifted, and the link pulls the front extension rack backwards to result in that the thigh supporting rack swings about a swinging center formed by the front end portion of the thigh supporting rack upwardly.

Since the lower leg supporting rack is swingable downwardly, a user lying on the rear frame can relax his/her lower legs. Further, the rear frame is modularized such that it can form an electric bed with a front frame. To store or transport the electric bed, the rear frame and the front frame can be dismantled from each other so as to store or transport the rear frame and the front frame, respectively. As a result, the electric bed provides comfort and convenience to users.

Further scope of applicability of the present disclosure will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
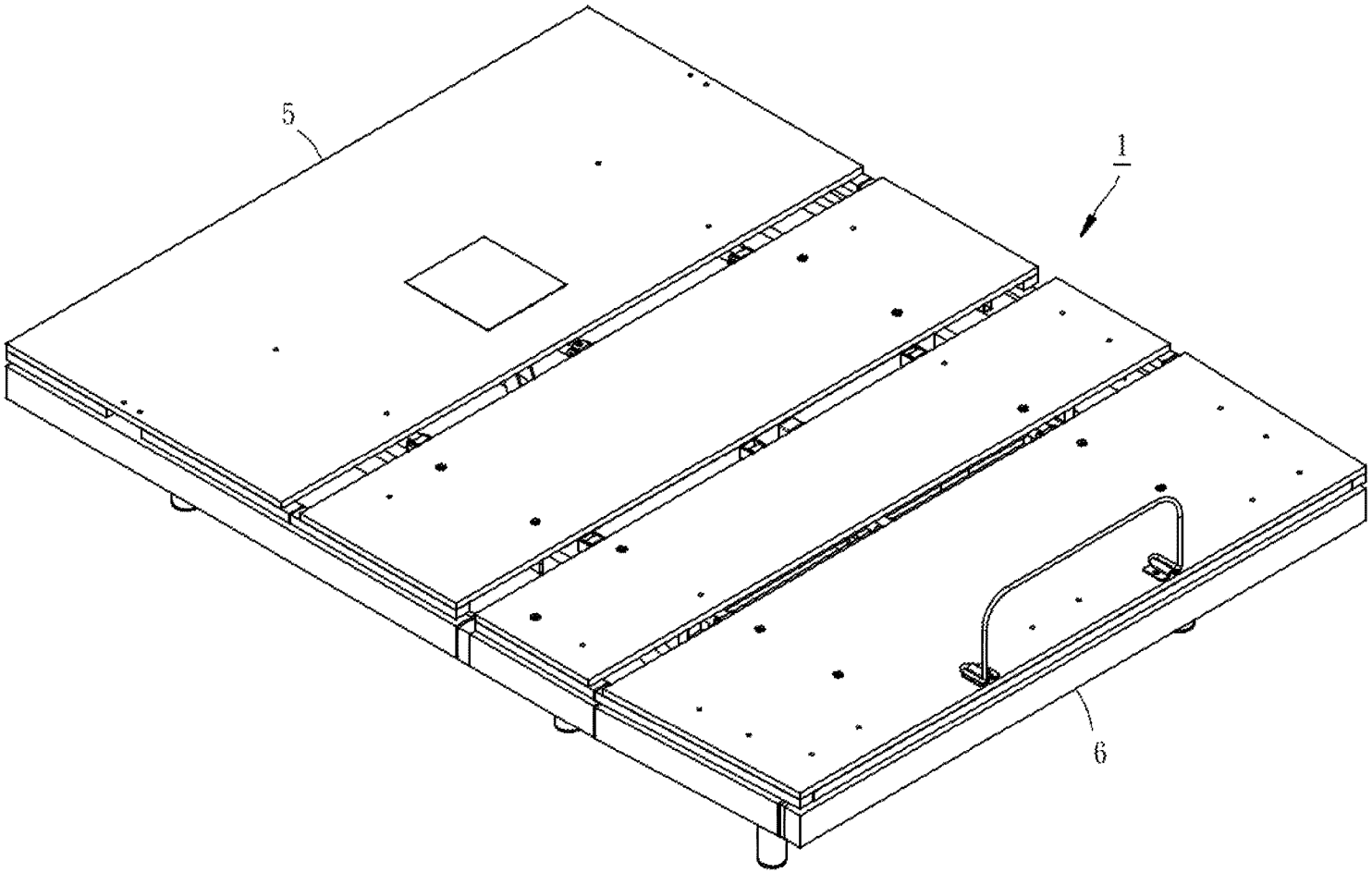
FIG. 1 is a perspective of an electric bed composed of a front frame and a rear frame according to a preferred embodiment of the present disclosure.
Figure 2:
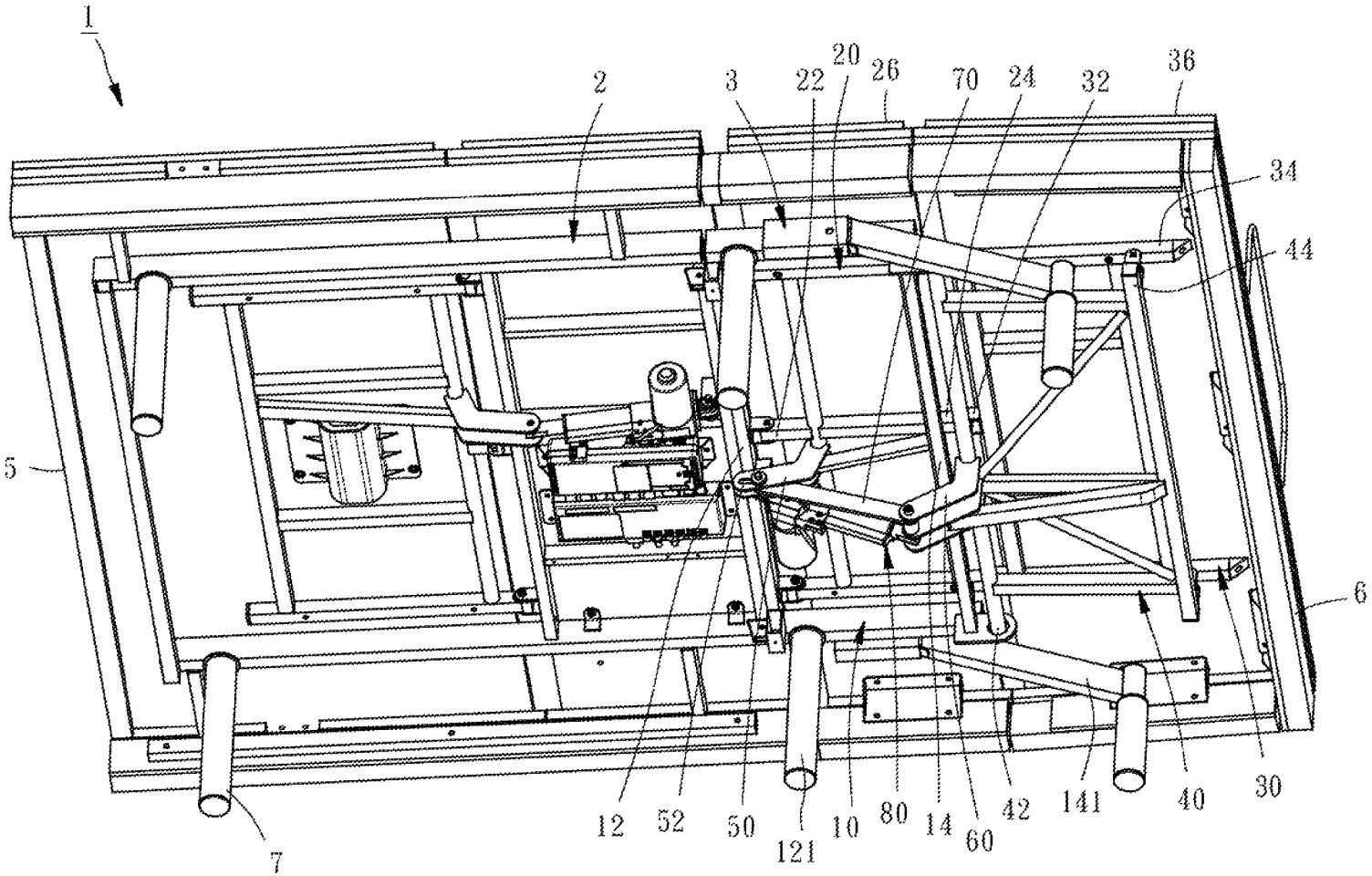
FIG. 2 is a bottom perspective view of the electric bed of FIG. 1.

Referring to FIGS. 1 and 2, a rear frame 3 of an electric bed 1 provided by a preferred embodiment of the present disclosure is adapted to be cooperated with a front frame 2 to completely form the electric bed 1, on which a mattress (not shown) is to be placed. Hereunder the direction toward the head 5 of the electric bed 1 is defined as a forth direction or front direction, and the direction toward the tail 6 of the electric bed 1 is defined as a back direction or rear direction.

The rear frame 3 is composed of a fixation rack 10, a thigh supporting rack 20, a lower leg supporting rack 30, a support rack 40, a front extension rack 50, a rear extension rack 60, a link 70, and an extendible and retractable actuator 80.

Figure 3:
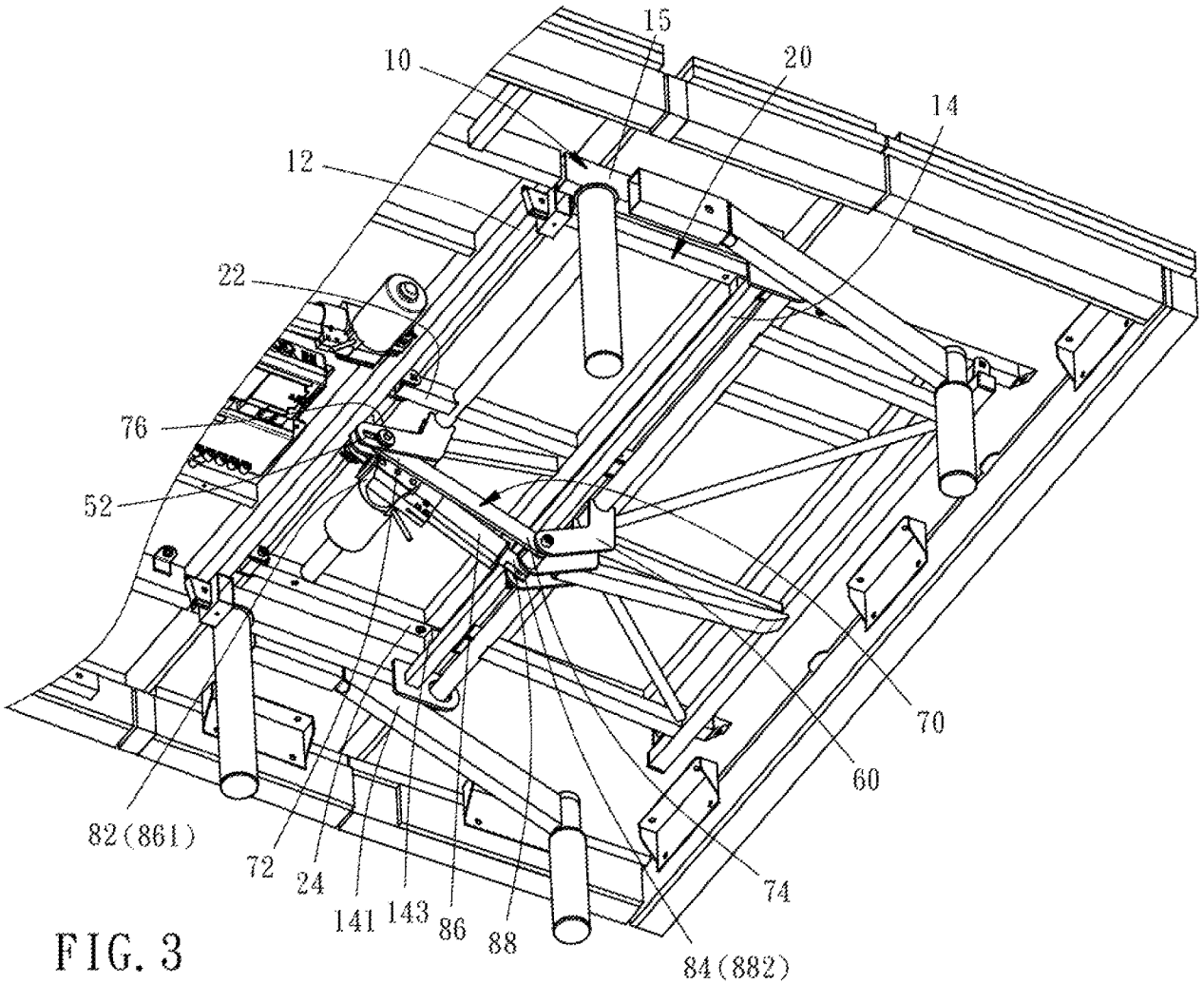
FIG. 3 is a partially bottom perspective view of the electric bed of FIG. 1, showing the rear frame in an enlarged scale.
Figure 4:
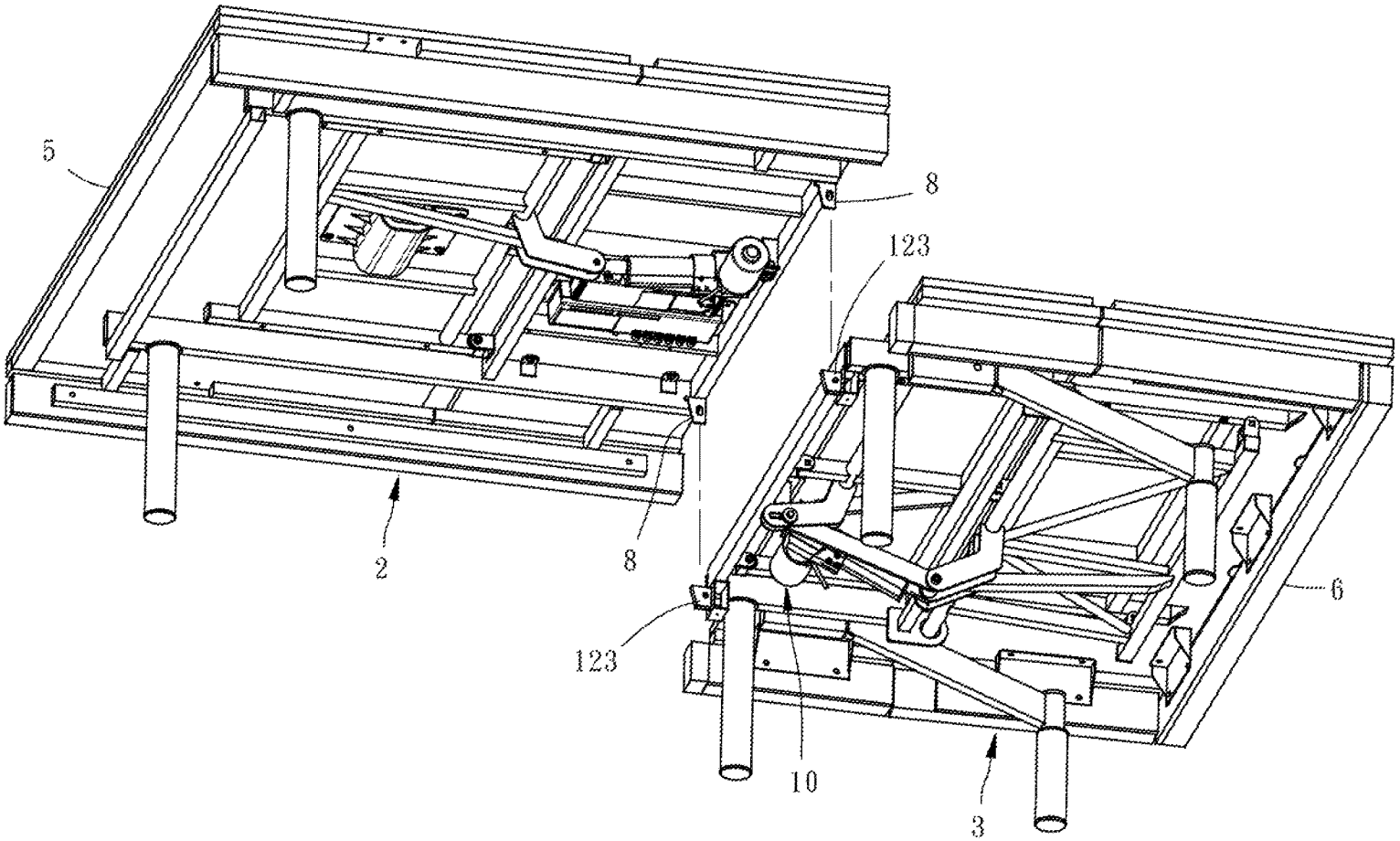
FIG. 4 is a bottom perspective exploded view of the electric bed of FIG. 1.

Referring to FIGS. 3 and 4, the fixation rack 10 is constructed by a plurality of rods 15 connected together and has substantially a rectangular shape. The fixation rack 10 stays stationary for being mounted and/or connected with other components and is provided with a front end portion 12 and a rear end portion 14. In this embodiment, the front end portion 12 is closer to the head 5 than the rear end portion 14 is, and the rear end portion 14 is closer to the tail 6 than the front end portion 12 is. The front end portion 12 is installed with two bed legs 121 and provided with two receiving slots 123. The rear end portion 14 is installed with another two bed legs 141 and two posts 143. The bed legs 121 and 141 and two bed legs 7 provided at the front frame 2 are configured to stand on a floor or on the ground, and two inserting plates 8 provided at the front frame 2 are configured to be detachably and respectively inserted into the receiving slots 123, such that the front frame 2 and the rear frame 3 can be conveniently assembled with or dismantled from each other. When the front frame 2 and the rear frame 3 are assembled together, the two bed legs 121 provided at the front end portion 12 can provide a stable supporting force to the connecting area between the front frame 2 and the rear frame 3. In another embodiment, the bed legs 121 provided at the front end portion 12 can be removed to and installed with the front frame 2. In another embodiment, the two bed legs 141 provided at the rear end portion 14 can be omitted. In such circumstance, the user can place the fixation rack 10 on any support, such as chair(s) in user's bedroom. In another embodiment, the two inserting plates 8 are provided at the rear frame 3, and the two receiving slots 123 are provide at the front frame 2. It will be appreciated that the way of assembling the front frame 2 and the rear frame 3 is not limited to the way disclosed in this embodiment.

The thigh supporting rack 20 has a front end portion 22 pivotally connected with the front end portion 12 of the fixation rack 10, and a rear end portion 24 disposed on the posts 143 of the rear end portion 14 of the fixation rack 10. In this embodiment, the front end portion 22 of the thigh supporting rack 20 is closer to the head 5 than the rear end portion 24 of the thigh supporting rack 20 is, and the rear end portion 24 of the thigh supporting rack 20 is closer to the tail 6 than the front end portion 22 of the thigh supporting rack 20 is. The rear frame 3 may further comprise a thigh supporting plate 26 disposed on the thigh supporting rack 20 for supporting a user's thighs. In another embodiment, the posts 143 can be omitted, and the rear end portion 24 of the thigh supporting rack 20 is therefore disposed on the rear end portion 14 of the fixation rack 10 directly.

The lower leg supporting rack 30 has a front end portion 32 pivotally connected with the rear end portion 24 of the thigh supporting rack 20, and a rear end portion 34. In this embodiment, the front end portion 32 of the lower leg supporting rack 30 is closer to the head 5 than the rear end portion 34 of the lower leg supporting rack 30 is, and the rear end portion 34 of the lower leg supporting rack 30 is closer to the tail 6 than the front end portion 32 of the lower leg supporting rack 30 is. The rear frame 3 may further comprise a lower leg supporting plate 36 disposed on the lower leg supporting rack 30 for supporting a user's lower legs.

Figure 5:
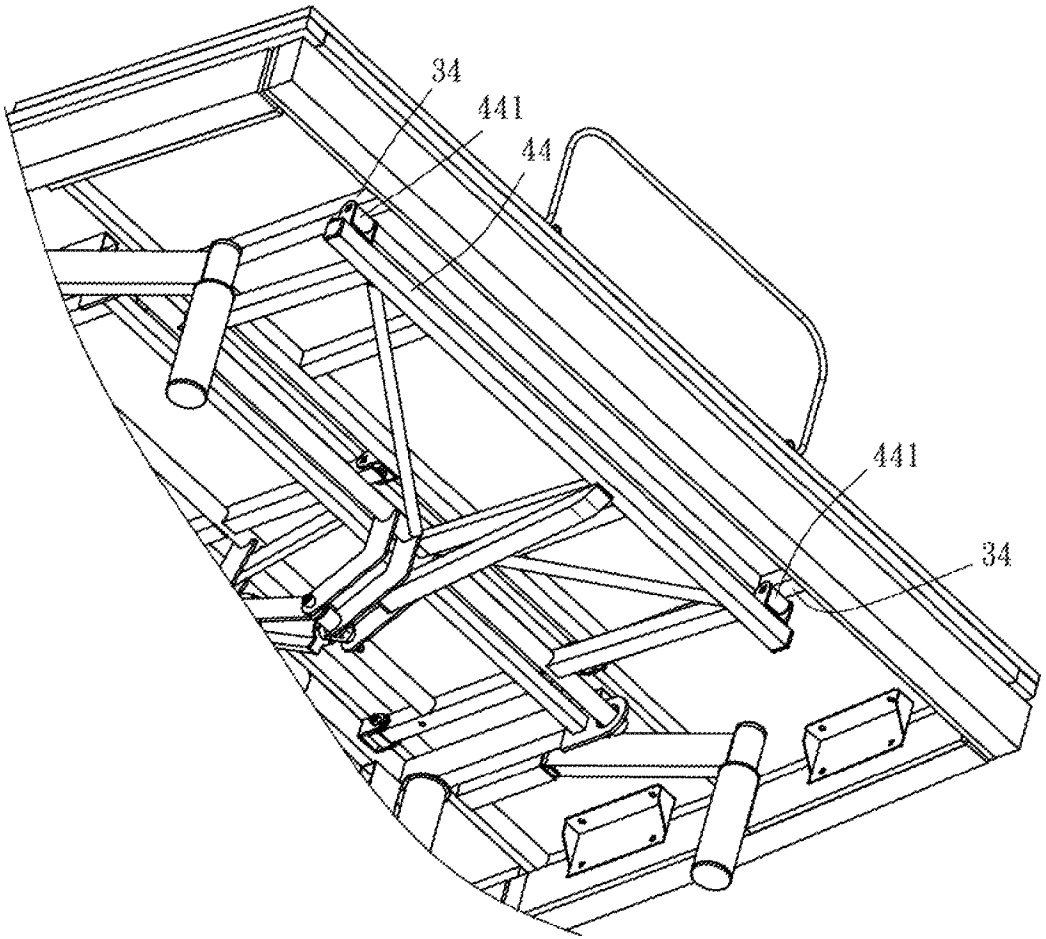
FIG. 5 is an enlarged partial bottom perspective view of the rear frame according to the preferred embodiment of the present disclosure.

The support rack 40 is located under the lower leg supporting rack 30 and has a front end portion 42 pivotally connected with the rear end portion 14 of the fixation rack 10, and a rear end portion 44 for being disposed with the rear end portion 34 of the lower leg supporting rack 30 thereon. In this embodiment, the front end portion 42 of the support rack 40 is closer to the head 5 than the rear end portion 44 of the support rack 40 is, and the rear end portion 44 of the support rack 40 is closer to the tail 6 than the front end portion 42 of the support rack 40 is. As shown in FIG. 5, the rear end portion 44 of the support rack 40 is provided with two rollers 441 rotatably contacted with the rear end portion 34 of the lower leg supporting rack 30, such that the rear end portion 44 of the support rack 40 and the rear end portion 34 of the lower leg supporting rack 30 can move relative to each other. In another embodiment, the two rollers 441 are replaced by rotatable members or slidable members, or can be omitted. The front extension rack 50 is disposed to a bottom side of the thigh supporting rack 20, i.e. located under the thigh supporting rack 20, and extends downwardly and forwards from the thigh supporting rack 20 with a sickle-like shape. The front extension rack 50 has an elongated groove 52 extending in a back-and-forth direction of the rear frame 3, i.e. a longitudinal direction passing through the head 5 and the tail 6, and located under the front end portion 22 of the thigh supporting rack 20. In another embodiment, the shape of the front extension rack 50 is not limited to a sickle-like shape as disclosed in this embodiment, and the location of the elongated groove 52 is also not limited to the location disclosed in this embodiment.

The rear extension rack 60 is disposed to a bottom side of the support rack 40, i.e. located under the support rack 40, and extends downwardly and forwards from the front end portion 42 of the support rack 40 with a sickle-like shape. In another embodiment, the shape of the rear extension rack 60 is not limited to a sickle-like shape as disclosed in this embodiment.

The link 70 has a front end portion 72 pivotally connected with the front extension rack 50 and reciprocally moveable along the elongated groove 52, and a rear end portion 74 pivotally connected with the rear extension rack 60. By means of a pin 76 that is slidably inserted through the elongated grove 52, the front end portion 72 of the link 70 can be pivotally and slidably connected with the front extension rack 50. In another embodiment, the connecting way between the link 70 and the front extension rack 50 may be different from the one disclosed in this embodiment.

The actuator 80 has a front end portion 82 pivotally connected with the front end portion 12 of the fixation rack 10, and a rear end portion 84 pivotally connected with the rear extension rack 60. The actuator 80 is configured to be extendible and retractable so as to change its length. In this embodiment, the actuator 80 is composed of a cylindrical member 86 and a telescopic rod 88 extending backwards from the cylindrical member 86 in a way that a front end portion 86 of the cylindrical member 86, namely the free end portion of the cylindrical member 86, forms the front end portion 82 of the actuator 80 and a rear end portion 882 of the telescopic rod 88, namely the free end portion of the telescope rod 88, forms the rear end portion 84 of the actuator 80. In another embodiment, the actuator 80 can be installed in a reverse orientation. In this way, the telescopic rod 88 is viewed extending forwards from the cylindrical member 86, such that the free end portion of the telescope rod 88, which is now the front end portion of the telescope rod 88, forms the front end portion 82 of the actuator 80, and the fee end portion of the cylindrical member 86, which is now a rear end portion of the cylindrical member 86, forms the rear end portion 84 of the actuator 80.

Figure 6:
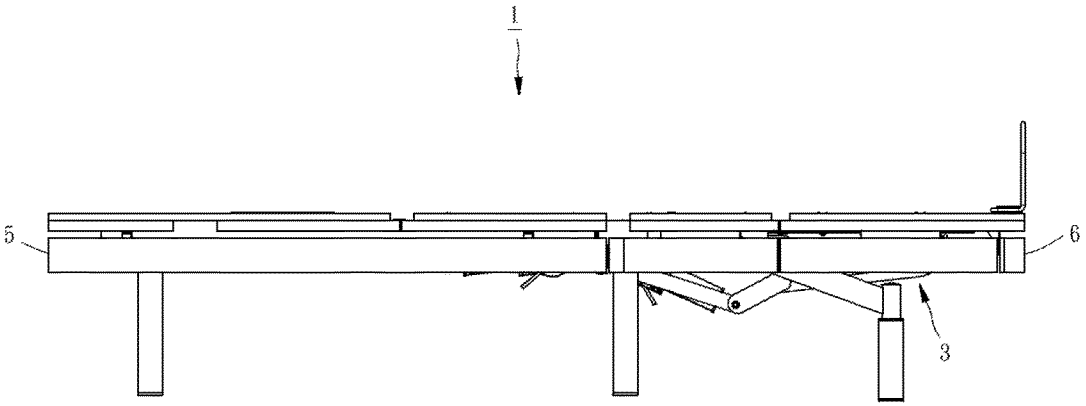
FIG. 6 is a lateral plan view of the electric bed of FIG. 1.
Figure 7:
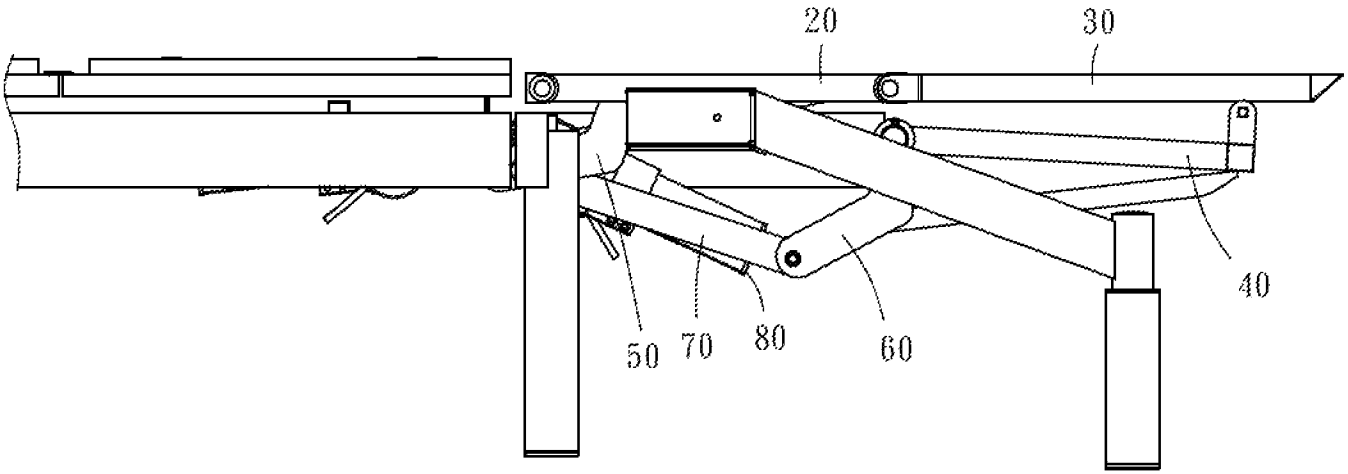
FIG. 7 is an enlarged partial cutaway lateral plan view of the electric bed of FIG. 6.

FIGS. 2 and 3 show that the actuator 80 stays at an initial status. In this status, a top side of the thigh supporting rack 20 is substantially flush with a top side of the lower leg supporting rack 30 and a stop side of the front frame 2, and the pin 76 is substantially stopped at a rear end of the elongated groove 52, as shown in FIGS. 1, 6 and 7.

Figure 8:
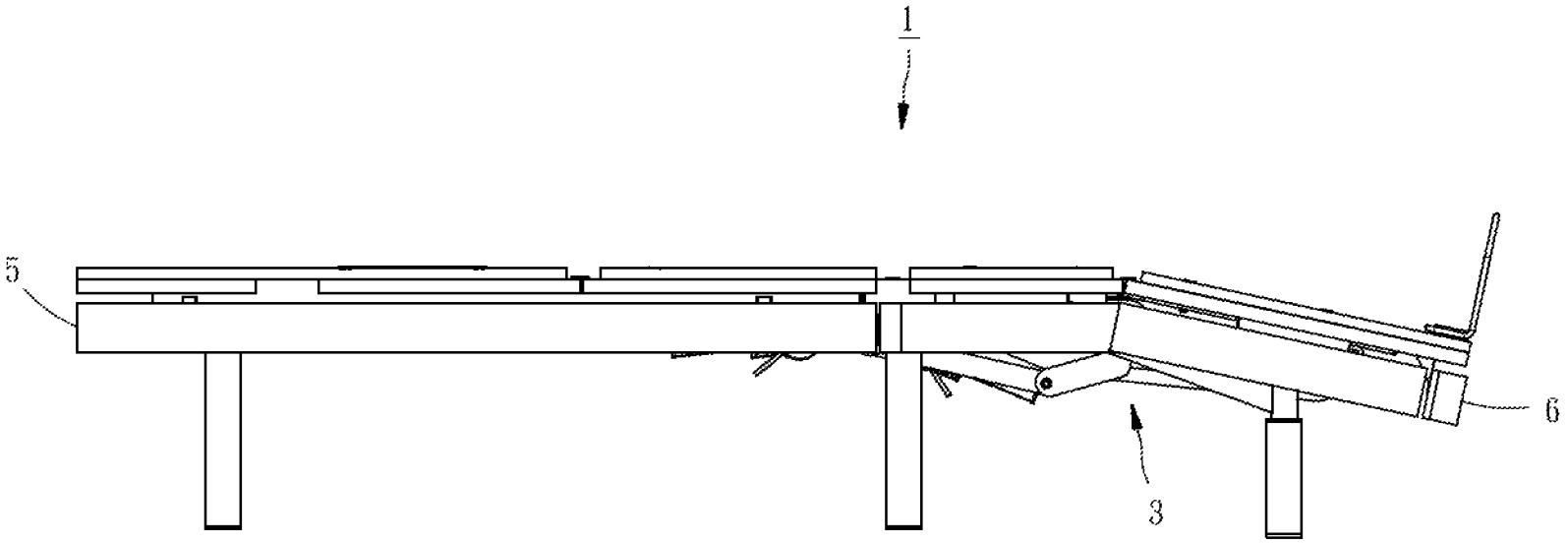
FIG. 8 is a lateral plan view showing a motion of the electric bed.
Figure 9:
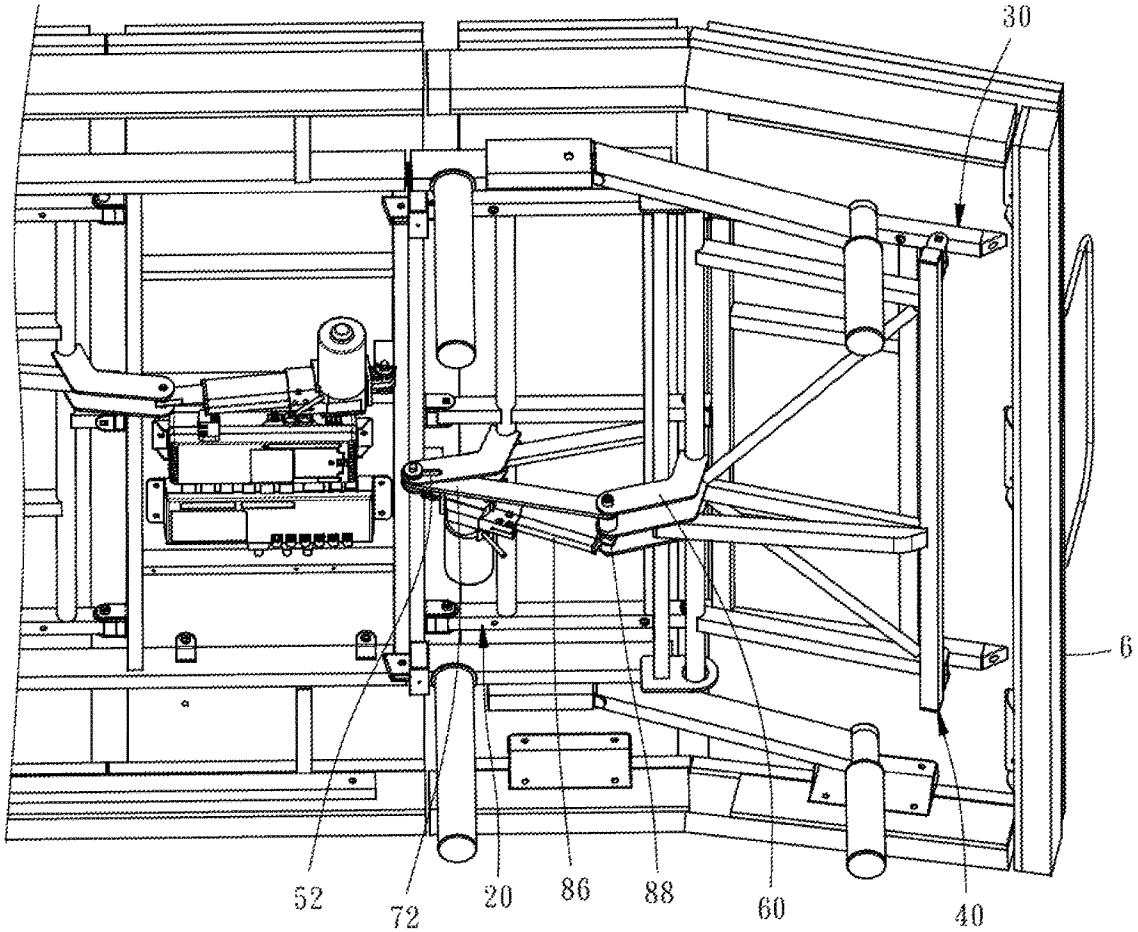
FIG. 9 is a partially bottom perspective view of the electric bed of FIG. 8.

Referring to FIGS. 8 and 9, when the actuator 80 retracts from the aforesaid initial status, the telescope rod 88 is retracted into an inside of the cylindrical member 86. As such, the telescope rod 88 of the actuator 80 pulls the rear extension rack 60 to force the support rack 40 to swing downwardly in such a way that the two rollers 441 of the support rack 40 roll along the rear end portion 344 of the lower leg supporting rack 30. As a result, the lower leg supporting rack 30 will also swing downwardly along with the support rack 40 in a way that the front end portion 72 of the link 70 and the pin 76 move forwards along the elongated groove 52, and the thigh supporting rack 20 stays stationary at its initial position. Under this circumstance, the user who lies on the electric bed 1 can lower and relax his/her lower legs. It could be understood that the retracting stroke of the telescope rod 88 will limit the downwardly swinging range of the support rack 40, and when the telescope rod 88 extends back to its initial position, the lower leg supporting rack 30 will return back to its initial position.

Figure 10:
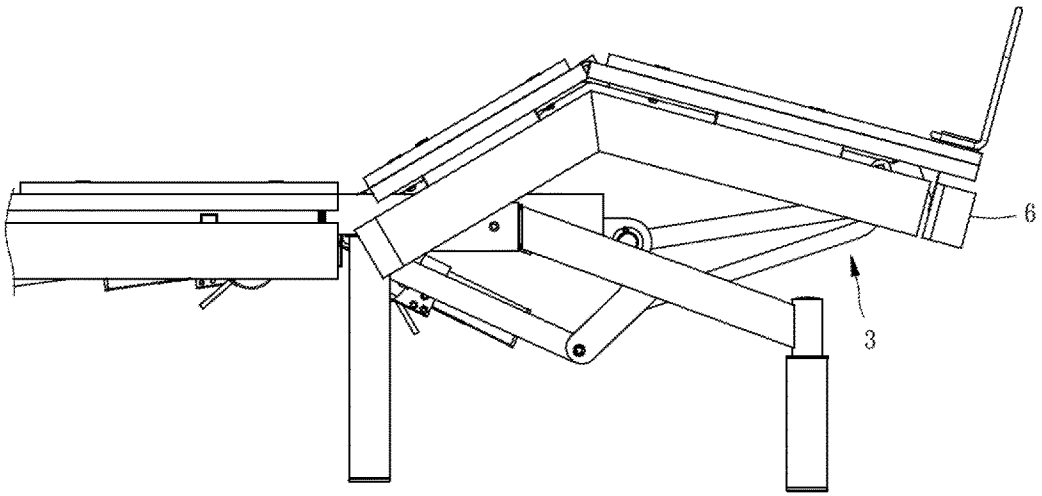
FIG. 10 is a lateral plan view showing another motion of the electric bed.
Figure 11:
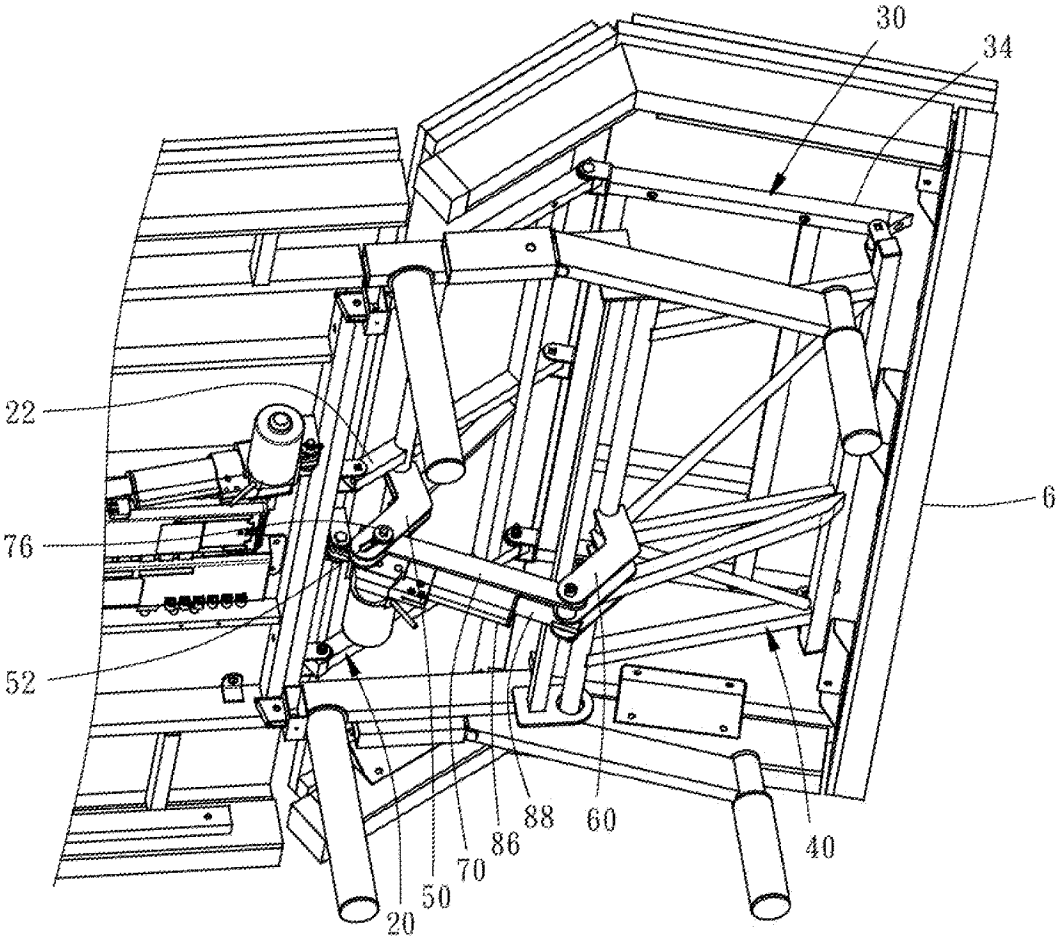
FIG. 11 is a bottom perspective view of the electric bed of FIG. 10.

Referring to FIGS. 10 and 11, when the actuator 80 extends from the aforesaid initial status, the telescope rod 88 extends outwardly from the cylindrical member 86. As such, the telescope rod 88 of the actuator 80 pushes the rear extension rack 60 to force the support rack 40 to swing upwardly in such a way that the two rollers 441 of the support rack 40 roll along the rear end portion 344 of the lower leg supporting rack 30 and the pin 76 is still stopped at the rear end of the elongated groove 52. As a result, the rear end portion 34 of the lower leg supporting rack 30 will be lifted, and the link 70 pulls the front extension rack 50 backwards to result in that the thigh supporting rack 20 swings about a swinging center formed by its front end portion 22 upwardly. Under this circumstance, the user who lies on the electric bed 1 can properly lift his/her thighs and lower legs relative to his/her buttocks in various angles, thereby achieving a relaxing purpose. It could be understood that the extending stroke of the telescope rod 88 will limit the upwardly swinging range of the support rack 40, and when the telescope rod 88 retracts back to its initial position, the thigh supporting rack 20 and the lower leg supporting rack 30 will return back to their initial positions, respectively.

With the above-disclosed features, the user can operate the electric bed 1 to do a lifting or lowering action so as to fulfill his/her need. In particular, the electric bed 1 of the present disclosure is provided with a variety of functions. For example, when the actuator 80 retracts from the above-mentioned initial status, the thigh supporting rack 20 stays stationary and the lower leg supporting rack 30 swings downwardly to relax the user's lower legs. To store or transport the electric bed 1, the user can dismantle the rear frame 3 from the front frame 2 in advance, and then store or transport the front and rear frames 2 and 3, respectively. Compared with conventional electric beds, the electric bed 1 of the present disclosure is convenient in usage, storage and transport. To use the electric bed 1, the user can easily assemble the front frame 2 and the rear frame 3 together by means of inserting the inserting plates 8 of the front frame 2 into the receiving slots 123 of the rear frame 3. However, the way of assembling the front frame 2 with the rear frame 3 is not limited to the one disclosed in this embodiment. For example, the front and rear frames 2 and 3 can be assembled by nuts and bolts.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rear frame of an electric bed, comprising:

a fixation rack having a front end portion and a rear end portion;

a thigh supporting rack having a front end portion pivotally connected with the front end portion of the fixation rack, and a rear end portion disposed on the rear end portion of the fixation rack;

a lower leg supporting rack having a front end portion pivotally connected with the rear end portion of the thigh supporting rack, and a rear end portion;

a support rack located under the lower leg supporting rack and provided with a front end portion pivotally connected with the rear end portion of the fixation rack, and a rear end portion on which the rear end portion of the lower leg supporting rack is disposed;

a front extension rack disposed to a bottom side of the thigh supporting rack and provided with an elongated groove extending in a back-and-forth direction of the rear frame;

a rear extension rack disposed to a bottom side of the support rack;

a link having a front end portion pivotally connected with the front extension rack and reciprocally moveable along the elongated groove, and a rear end portion pivotally connected with the rear extension rack; and an extendible and retractable actuator having a front end portion pivotally connected with the front end portion of the fixation rack, and a rear end portion pivotally connected with the rear extension rack, the actuator being extendible and retractable to change its length;

wherein when the actuator stays in an initial status, a top side of the thigh supporting rack is flush with a top side of the lower leg supporting rack;

wherein when the actuator retracts from the initial status, the actuator pulls the rear extension rack to force the support rack to swing downwardly, such that the lower leg supporting rack swings downwardly along with the support rack, the front end portion of the link moves forwards along the elongated groove, and the thigh supporting rack stays stationary;

wherein when the actuator extends from the initial status, the actuator pushes the rear extension rack to force the support rack to swing upwardly, such that the rear end portion of the lower leg supporting rack is lifted, and the link pulls the front extension rack backwards to result in that the thigh supporting rack swings about a swinging center formed by the front end portion of the thigh supporting rack upwardly.

2. The rear frame as claimed in claim 1, wherein the front end portion of the link is pivotally connected with the front extension rack by a pin that is disposed in the elongated groove; when the actuator extends from the initial status, the pin is stopped at a rear end of the elongated groove.

3. The rear frame as claimed in claim 1, wherein the rear end portion of the fixation rack is installed with two bed legs.

4. The rear frame as claimed in claim 3, wherein the front end portion of the fixation rack is installed with two bed legs.

5. The rear frame as claimed in claim 1, wherein the front extension rack extends downwardly and forwards from the thigh supporting rack.

6. The rear frame as claimed in claim 1, wherein the rear extension rack extends downwardly and forwards from the front end portion of the support rack.

7. The rear frame as claimed in claim 1, wherein the elongated groove is located under the front end portion of the thigh supporting rack.

8. The rear frame as claimed in claim 1, wherein the actuator comprises a cylindrical member and a telescopic rod extending backwards from the cylindrical member; a front end portion of the cylindrical member forms the front end portion of the actuator and a rear end portion of the telescopic rod forms the rear end portion of the actuator.

9. The rear frame as claimed in claim 1, wherein the actuator comprises a cylindrical member and a telescopic rod extending forwards from the cylindrical member; a front end portion of the telescopic rod forms the front end portion of the actuator and a rear end portion of the cylindrical member forms the rear end portion of the actuator.

10. The rear frame as claimed in claim 1, configured to from an electric bed with a front frame of the electric bed.

* * * * *